US006775994B1

(12) United States Patent
Math et al.

(10) Patent No.: US 6,775,994 B1
(45) Date of Patent: Aug. 17, 2004

(54) REFRIGERATED DISPLAY MERCHANDISER WITH VARIABLE AIR CURTAIN

(75) Inventors: Jeffrey A. Math, Wallingford, CT (US); Dochul Choi, Lexington, MA (US)

(73) Assignee: Carrier Commercial Refrigeration, Inc., Aurora, IL (US)

( * ) Notice: Subject to any disclaimer, the term of this patent is extended or adjusted under 35 U.S.C. 154(b) by 0 days.

(21) Appl. No.: 10/374,938

(22) Filed: Feb. 25, 2003

(51) Int. Cl.[7] ..... A47F 3/04
(52) U.S. Cl. ..... 62/89; 62/186; 62/256
(58) Field of Search ..... 62/89, 186, 255, 62/256

(56) References Cited

U.S. PATENT DOCUMENTS 3,444,698 A * 5/1969 Lorenz ..... 62/128
3,771,323 A * 11/1973 Simons et al. ..... 62/89
5,255,530 A 10/1993 Janke
5,870,898 A 2/1999 Choi
6,058,722 A * 5/2000 Choi ..... 62/153
6,112,546 A * 9/2000 Kim ..... 62/440
6,138,460 A 10/2000 Lee
6,619,052 B1 * 9/2003 Nash, Jr. ..... 62/89

FOREIGN PATENT DOCUMENTS

EP 0540874 A2 5/1993
GB 2011071 A 7/1979

* cited by examiner

*Primary Examiner*—William E. Tapolcai

(57) ABSTRACT

A refrigerated merchandiser (12) includes a display case (30) defining a product display region having an open-front isolated from the ambient air of the store by means of a downwardly directed inner air curtain (55) of relatively cold refrigerated air. The amount of airflow forming the air curtain is selectively increased in response to a signal from a controller (80) whenever a sensor (70) detects a disturbance in the integrity of the air curtain or from movement in front of the display case.

16 Claims, 2 Drawing Sheets

REFRIGERATED DISPLAY MERCHANDISER WITH VARIABLE AIR CURTAIN

BACKGROUND OF THE INVENTION

The present invention relates generally to refrigerated display merchandisers of the type used in supermarkets, mini-marts, convenience stores and other commercial establishments for displaying and merchandising refrigerated or frozen products for sale. More particularly, the present invention relates to open-front refrigerated display merchandisers of the type wherein a curtain of cold refrigerated air is passed generally downwardly across the open front product display region of the merchandiser.

Refrigerated display merchandisers, also commonly referred to as display cases, having open front display regions are commonly used in supermarkets, mini-marts, convenience stores and other commercial establishments for displaying and merchandising refrigerated or frozen products for sale. The open front nature of such display cases permits the consumer to simply reach into the product display region to select and remove a product for purchase without the inconvenience of needing to open a door to access the product. Customarily, a curtain of cold refrigerated air is passed generally downwardly at a set velocity across the open front of the display case to form an invisible boundary between the product display region and the region of the store in front of the display case. This air curtain not only helps retain cool refrigerated air within the product display region of the display case, thereby cooling the display product on the shelves of the display case, but also functions to isolate, to a certain extent, the product display region from the ambient air within the store. Ambient air that does enter into open product display region undesirably causes increased energy consumption by increasing the cooling demand on the refrigeration system associated with the display case. Further, such ambient air may also cause a local temperature rise within the product display region sufficient to result in an undesirable rise in product temperature that could adversely impact upon product quality.

Significant intrusion of ambient air into the interior of the display case occurs when consumers reach into the product display region to select and remove product. Customers walking by the open front of the display case may also disturb the integrity of the air curtain, resulting in intrusion of ambient air from the store into the product display region. To reduce the amount of intrusion and ensure rapid reestablishment of the air curtain, it is common practice to maintain the air curtain at a relatively high velocity. As the volume of air being supplied to generate the air curtain is directly proportional to the required velocity of the air curtain, maintaining a relatively high velocity for the air curtain requires greater energy consumption, which increases store operational costs. Therefore, it would be desirable to reduce the energy consumption by lowering overall energy consumption in generating the air curtain.

SUMMARY OF THE INVENTION

It is an object of the present invention to provide a refrigerated merchandiser including an improved air curtain system that consumes less energy overall. It is a further object of the present invention to provide a refrigerated merchandiser including a air curtain system wherein the velocity of the air curtain is varied between a relatively lower velocity maintained during steady-state operation and a relatively higher velocity in response to a sensed disturbance in the air curtain or sensed motion in front of the display case.

The refrigerated merchandiser of the present invention includes a display case defining a product display region having an open-front isolated from the ambient air of the store by means of at least one generally downwardly directed air curtain of relatively cold refrigerated air. In accordance with the present invention, a sensor is positioned in operative association with the display case to sense a disturbance in the air curtain or to detect consumer activity in the store region immediately in front of the product display case. The sensor provides an output signal to a controller, the output signal indicating the existence of a disturbance in the integrity of the air curtain or motion in the monitored region depending upon which of the aforementioned sensors is installed. The controller in turn operates to increase the velocity of the air curtain from a relatively lower velocity maintained during steady-state operation to a relatively higher velocity.

BRIEF DESCRIPTION OF THE DRAWINGS

The various features and advantages of this invention will become apparent to those skilled in the art from the following detailed description of the currently preferred embodiment with reference to the accompany drawings wherein.

DETAILED DESCRIPTION OF THE PREFERRED EMBODIMENT

Figure 1:
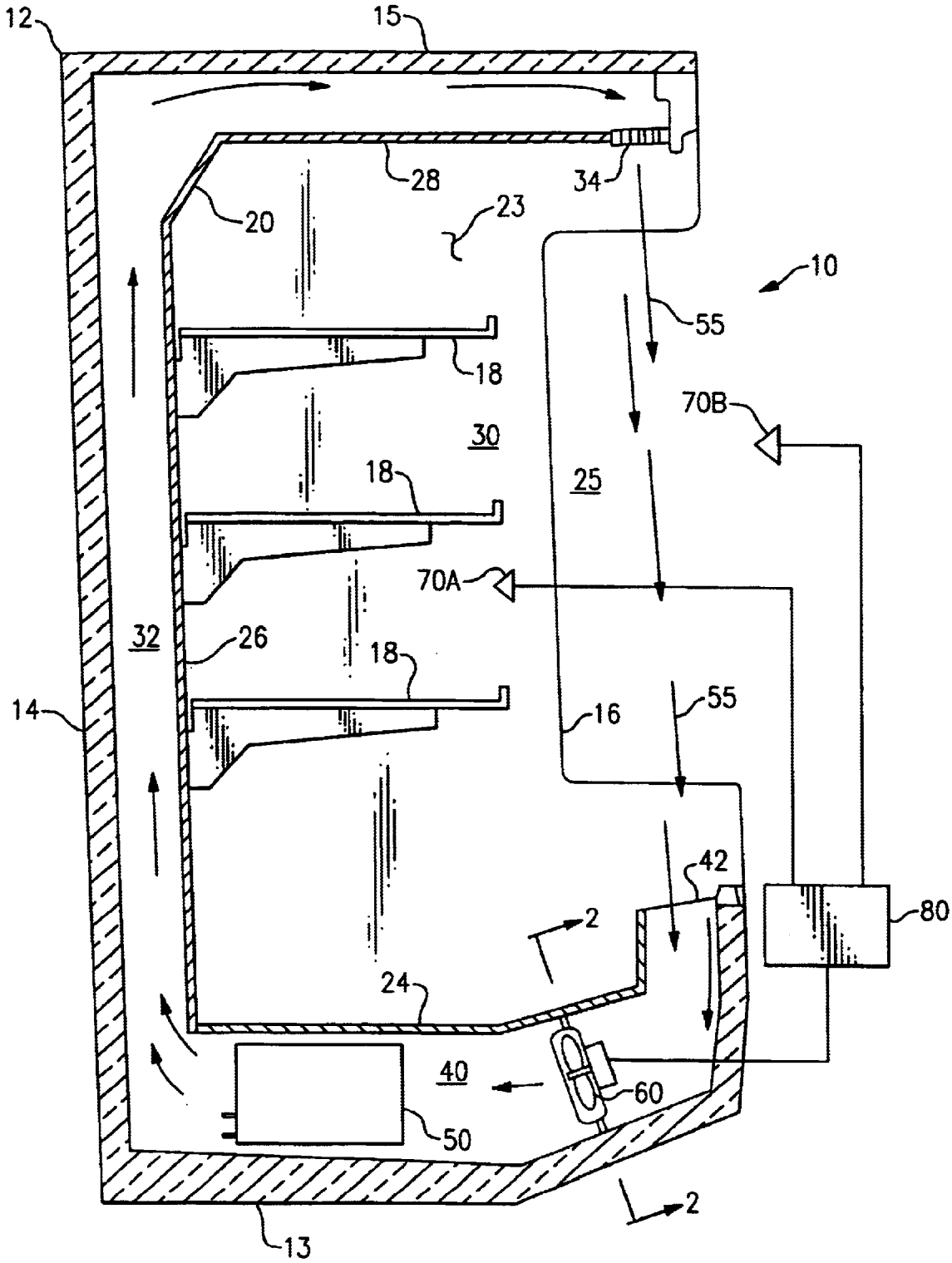
FIG. 1 is a sectional, side elevation profile of an embodiment of the refrigerated merchandiser of the present invention.

Referring now to FIG. 1, the refrigerated merchandiser 10 includes an outer cabinet 12 and an inner cabinet liner 20 that defines within its bounds an open-front product display case 30. The outer cabinet has a base 13, a rear wall 14 extending upwardly from the back of the base 13, a top wall 15 extending forwardly from the rear wall and a pair of side walls 16 extending vertically from the base 13 to the top wall 15 and forwardly from the rear wall 14. The inner cabinet liner 20 has a top panel 28, a back panel 26, a bottom panel 24 and opposed side panels 23 which together bound the open-front product display case 30. Each of the cabinet base 13, rear wall 14, top wall 15 and side walls 16 is insulated, as in conventional practice, to thermally isolate the interior of the cabinet 12, including the product display case 30, from excessive heat transfer therethrough.

Perishable product being merchandized may be displayed on shelves 18 disposed within the product display case 30 and upon the upper surface of the bottom panel 24. The product display case 30 has an open front 25 so as to permit consumers to not only view, but also reach into the product display case 30 to select and remove items of product (not shown) that they desire to purchase. Product display case 30 is cooled in a conventional manner to a desired product temperature, typically to a temperature between −10° F. to less than about 40° F., depending upon what product is being merchandised therein and whether the product is frozen or non-frozen.

Figure 2:
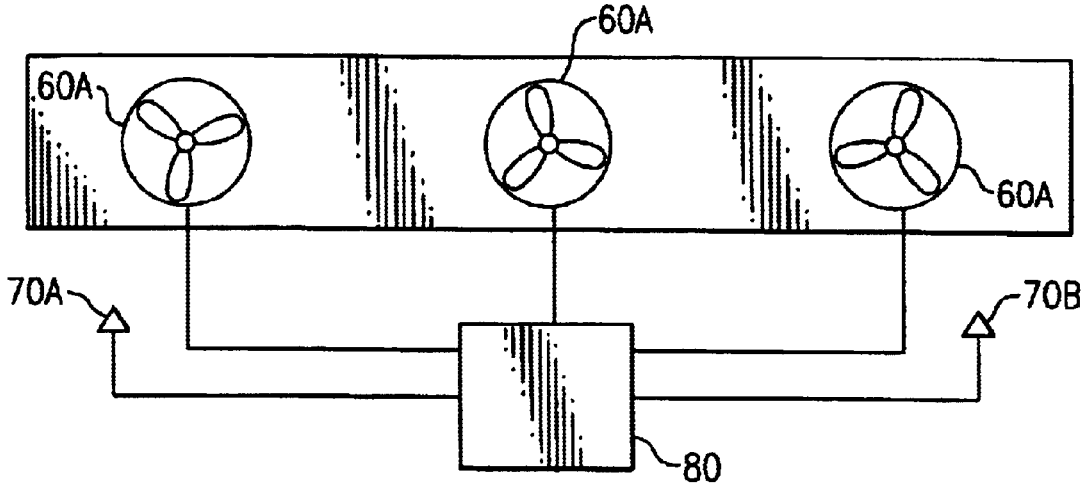
FIG. 2 is a partly sectioned, planar view, taken along line 2—2 of FIG. 1, showing a multi-fan embodiment of the refrigerated display case of the present invention incorporating variable capacity fans.
Figure 3:
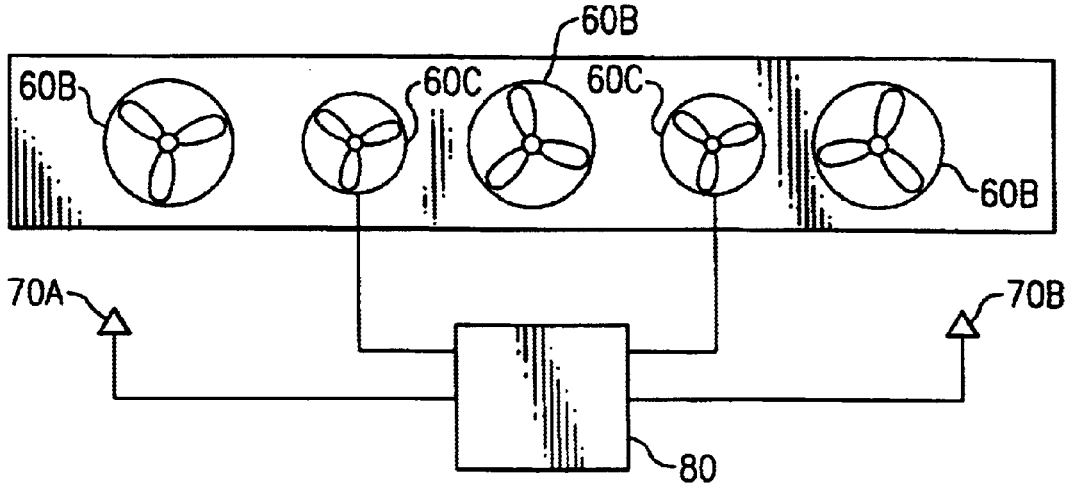
FIG. 3 is a partly sectioned, planar view, taken along line 2—2 of FIG. 1, showing a multi-fan embodiment of the refrigerated display case of the present invention incorporating fixed capacity fans.

The refrigerated merchandiser 10 further includes a refrigeration compartment 40, typically disposed in the portion of the display cabinet 12 between the base 13 and the bottom panel 24, as depicted in FIG. 1, wherein components of the refrigerant system, typically a tube coil evaporator 50 and a air circulator, such as for example one or more fans 60, are housed. For example, in one embodiment of the present invention as illustrated in FIG. 2, three variable capacity fans 60A are disposed at spaced intervals across the width of the display case. In another embodiment of the present invention as illustrated in FIG. 3, five fixed capacity fans 60B and 60C are disposed at spaced intervals across the width of the display case. It will be appreciated by those skilled in the art that the number of fans employed is a matter of choice that will depend upon the width of the display case, the capacity of the fans and whether the fans are of a fixed or variable capacity variety. As in conventional practice, refrigerant passing through the tubes of the evaporator 50 cools air passing over the surface of the evaporator tubes. The refrigerant is typically supplied from a remote refrigeration unit located elsewhere within the store. However, it is to be understood that the present invention may also be employed on stand alone refrigerated merchandisers that include their own refrigeration unit for providing the cold refrigerant.

An air circulation duct 32 is formed between the rear wall 14 and the top wall 15 of the outer cabinet 12 and the back panel 26 and top panel 28, respectively, of the inner cabinet liner 20. The fans 60 serve to circulate air from air inlet 42 through the compartment 40 so as to traverse evaporator 50, and thence through duct 32 to an air outlet 34. As noted before, this circulating air has been cooled to a desired temperature as it traverses the evaporator 50. From the air outlet 34, the cool refrigeration air is directed via vanes provided within the air outlet 34 downwardly along a path across the open front 25 of the product display region back to air inlet 42. Thus, the refrigerating air is recycled and repeatedly recirculated through the compartment 40 and duct 32 to converse energy expended in cooling the refrigeration air. Further, through the aforedescribed cooling arrangement, a cool air curtain 55 is formed across the open-front product display case 30 from top to bottom thereof. To provide further cooling air directly to the product display case 30, a plurality of openings may be provided in the back panel 26 through which a portion of cold refrigerating air circulating through duct 32 may pass directly into the product display case 30. Refrigerating air will also be drawn by the fans 60 back through the air inlet 42 into the compartment 40 to be recirculated.

In accordance with the present invention, at least one sensor 70 is disposed in operative association with the product display case 30. The at least one sensor may comprise a sensor 70A for detecting a disturbance in the curtain of airflow and/or a motion sensor 70B for detecting movement in front of the open-front display case 30. As noted previously, such a disturbance may be caused by a customer reaching into the product display case 30 to select a product for purchase or even by a customer walking by or otherwise moving in front of the open-front product display case 30. The sensor 70 communicates with a controller 80 operative to control at least one fan 60 to increase airflow in the air curtain 55 in response to a signal from the sensor indicating detection of a disturbance in the air curtain or movement in front of the display case 30. By increasing the airflow forming the cold air curtain passing across the open-front of the product display case 30 in response to a disturbance in the air curtain or movement in front of the product display case 30, a stable air curtain is reestablished more quickly, resulting in lower infiltration of warm, moist air from the store into the product display case, thereby lowering overall energy consumption.

In the embodiment of the present invention depicted in FIG. 2, at least one of the fans 60A, and most advantageously each of the fans 60A, is of variable capacity, having at least a first relatively lower capacity and at least a second relatively higher capacity. Each of the variable capacity fans 60A is in communication with the controller 80 and, in response to a signal from the controller 80, will switch from operating at its first relatively lower capacity to operating at its second relatively higher capacity. The controller 80 will send such a capacity increase signal to each variable speed fan 60A whenever the controller 80 receives a signal from the sensor 70 indicating detection of a disturbance in the air curtain or movement in front of the display case 30. Once the disturbance or movement is no longer present, the sensor 70 will cease signaling the controller 80. In response, the controller 80 will signal each variable capacity fan 60A to return to its first relatively lower capacity for continued steady-state operation.

Each variable capacity fan 60A may advantageously comprise an adjustable speed fan wherein a variable speed motor associated with the fan responds to the controller 80 to increase the speed at which the fan blades rotate, thereby increasing the rate of airflow passing through the fan. Alternatively, each variable capacity fan 60A may be a constant speed fan having variable pitch blades wherein the pitch, i.e. angle, of the fan blades changes in response to the controller 80 to increase the airflow passing through the fan. It is to be understood that one of ordinary skill in the art may envision other techniques for adjusting the capacity of a fan to control the amount of airflow forming the air curtain without departing from the spirit and scope of the present invention.

In the embodiment of the present invention depicted in FIG. 3, the fans 60B and 60C are fixed capacity fans. Fans 60B are the primary air circulating fans for establishing the air curtain 55 and fans 60C are secondary air circulating fans that operate only when called upon by controller 80 to increase the airflow forming the air curtain 55. Each of the secondary fans 60C is in communication with the controller 80 and, in response to a signal from the controller 80, will activate to cause additional airflow to the air curtain 55. The controller 80 will send such a capacity increase signal to each fan 60C whenever the controller 80 receives a signal from the sensor 70 indicating detection of a disturbance in the air curtain or movement in front of the display case 30. Once the disturbance or movement is no longer present, the sensor 70 will cease signaling the controller 80. In response, the controller 80 will signal each secondary fan 60A to deactivate, thereby returning the air curtain airflow to the lower rate generated by the steady-state operation of the primary fans 60B.

The aforementioned description is meant to be exemplary rather than limiting. Many modifications and variations of the present invention as described may be recognized by those skilled in the art in light of the above teachings that will fall within the spirit and scope of the present invention. The preferred embodiments of this invention have been disclosed. Accordingly, within the scope of the appended claims, the invention may be practiced otherwise than as specifically described. For this reason the following claims should be studied to determine the true scope and content of this invention.

What is claimed is:

1. A refrigerated merchandiser comprising;

a display case having an exterior and an interior, the interior defining a product display region having an open-front viewing area;

at least one fan associated with said display case for establishing a curtain of airflow passing generally downwardly across the open-front viewing area of the display region;

at least one sensor associated with said display case for detecting a disturbance in said curtain of airflow; and a controller operatively associated with said at least one fan and said at least one sensor, said controller controlling said at least one fan to increase airflow in said curtain of airflow in response to said sensor detecting a disturbance in said curtain of airflow.

2. A refrigerated merchandiser as recited in claim 1 wherein said at least one fan comprises at least one variable capacity fan having at least a first capacity and a second capacity, the second capacity being significantly higher than the first capacity.

3. A refrigerated merchandiser as recited in claim 2 wherein said at least one variable capacity fan operates at the first capacity during steady state operation and at the second capacity in response to said controller in response to said sensor detecting a disturbance in said curtain of airflow.

4. A refrigerated merchandiser as recited in claim 1 wherein said at least one fan comprises at least one variable speed fan having at least a first speed and a second speed, the second speed being significantly higher than the first speed.

5. A refrigerated merchandiser as recited in claim 4 wherein said at least one variable speed fan operates at the first speed during steady state operation and at the second speed in response to said controller in response to said sensor detecting a disturbance in said curtain of airflow.

6. A refrigerated merchandiser as recited in claim 1 wherein said at least one fan comprises at least one first fan and at least one second fan, said at least one second fan being controlled by said controller to operate in conjunction with said at least one first fan in response to said sensor detecting a disturbance in said curtain of airflow.

7. A refrigerated merchandiser as recited in claim 6 wherein said at least one first fans comprises a plurality of first fans.

8. A refrigerated merchandiser as recited in claim 7 wherein said at least one second fan comprises a plurality of second fans.

9. A refrigerated merchandiser comprising;

a display case having an exterior and an interior, the interior defining a product display region having an open-front;

at least one fan associated with said display case for establishing a curtain of airflow passing generally downwardly across the open-front viewing area of the display region;

at least one sensor associated with said display case for detecting motion in vicinity of the open-front of said display case; and a controller operatively associated with said at least one fan and said at least one sensor, said controller controlling said at least one fan to increase airflow in said curtain of airflow in response to said sensor detecting motion in vicinity of the open-front of said display case.

10. A refrigerated merchandiser as recited in claim 9 wherein said at least one fan comprises at least one variable speed fan having at least a first speed and a second speed, the second speed being significantly higher than said first speed.

11. A refrigerated merchandiser as recited in claim 10 wherein said at least one variable speed fan operates at the first speed during steady state operation and at the second speed in response to said controller in response to said sensor detecting a disturbance in said curtain of airflow.

12. A refrigerated merchandiser as recited in claim 9 wherein said at least one fan comprises at least one first fan and at least one second fan, said at least one second fan being controlled by said controller to operate in conjunction with said at least one first fan in response to said sensor detecting a disturbance in said curtain of airflow.

13. A refrigerated merchandiser as recited in claim 12 wherein said at least one first fan comprises a plurality of first fans.

14. A refrigerated merchandiser as recited in claim 13 wherein said at least one second fan comprises a plurality of second fans.

15. A method of operating a refrigerated merchandiser having a display case having an exterior and an interior, the interior defining a product display region having an open-front viewing area and at least one fan associated with said display case for establishing a curtain of airflow passing generally downwardly across the open-front viewing area of the display region, said method comprising:

detecting a disturbance in said curtain of airflow; and controlling said at least one fan to increase airflow in said curtain of airflow in response to the detecting of a disturbance in said curtain of airflow.

16. A method of operating a refrigerated merchandiser having a display case having an exterior and an interior, the interior defining a product display region having an open-front viewing area and at least one fan associated with said display case for establishing a curtain of airflow passing generally downwardly across the open-front viewing area of the display region, said method comprising:

detecting motion in vicinity of the open-front of said display case; and controlling said at least one fan to increase airflow in said curtain of airflow in response to said sensor detecting motion in vicinity of the open-front of said display case.

* * * * *